United States Patent [19]

Kellerwessel et al.

[11] Patent Number: 4,753,660

[45] Date of Patent: Jun. 28, 1988

[54] METHOD FOR THE PRODUCTION OF A COAL SUSPENSION

[75] Inventors: Hans Kellerwessel, Aachen; Hans-H. Gildemeister, Overath-Brombach; Jurek Golda, Bielefeld; Peter Zahr, Bergisch Gladbach; Gerhard Keichel, Wülfrath, all of Fed. Rep. of Germany

[73] Assignee: Klöckner-Humboldt-Deutz Aktiengesellschaft, Fed. Rep. of Germany

[21] Appl. No.: 840,034

[22] Filed: Mar. 17, 1986

[30] Foreign Application Priority Data

Mar. 15, 1985 [DE] Fed. Rep. of Germany ..... 3509330

[51] Int. Cl.[4] ..... C10L 1/32

[52] U.S. Cl. ..... 44/51; 241/16; 241/29; 241/41; 241/42; 241/43; 241/62

[58] Field of Search ..... 44/51; 241/16, 29, 41, 241/42, 43, 62

[56] References Cited

U.S. PATENT DOCUMENTS

| | | | |
|---|---|---|---|
| 1,737,800 | 12/1929 | London | 241/43 |
| 2,877,954 | 3/1959 | Myers | 241/29 |
| 3,078,050 | 2/1963 | Hardinge | 241/29 |
| 3,506,200 | 4/1970 | Raudenbush | 241/62 |
| 3,727,849 | 4/1973 | Kjos et al. | 241/43 |
| 3,948,448 | 4/1976 | Wehren | 241/62 |
| 4,113,189 | 9/1978 | Sullivan | 241/43 |
| 4,162,044 | 7/1979 | Manfroy | 241/16 |
| 4,369,926 | 1/1983 | Rasmussen et al. | 241/29 |
| 4,441,887 | 4/1984 | Funk | 44/51 |
| 4,552,568 | 11/1985 | Igarashi et al. | 44/51 |
| 4,613,084 | 9/1986 | Takamoto et al. | 44/51 |

FOREIGN PATENT DOCUMENTS 2135211 8/1984 United Kingdom .

*Primary Examiner*—William R. Dixon, Jr.
*Assistant Examiner*—Margaret B. Medley
*Attorney, Agent, or Firm*—Hill, Van Santen, Steadman & Simpson

[57] ABSTRACT

The invention relates to an apparatus and method for producing a free flowing coal suspension high in solids content. The coal is ground in at least two stages utilizing a mill having a calibrating effect in one stage and a mill without calibrating effect in another stage and adding a sub-quantity of viscosity reducing additive to the coal before each grinding. A drying of the coal or reconcentration of the suspension is not required. A roller mill operating on the principle of materials bed comminution is preferred as the non-calibrating mill in the first grinding stage and a rotating drum mill or a vibration grinding mill with rods as grinding bodies is preferred as the calibrating mill.

14 Claims, 5 Drawing Sheets

| TRIAL | P. 28 COMPONENT IN % | P. 26 COMPONENT IN % | DEFROTHER | MEASURING INSTRUMENT | SHEAR RATE ($S^{-1}$) | VISCOSITY (M PAS) | COAL CONCENTRATION BEFORE MEASUREMENT IN % | COAL CONCENTRATION AFTER MEASUREMENT IN % | |
|---|---|---|---|---|---|---|---|---|---|
| | | | | | | | | UPPER | LOWER |
| 1 | 100 | 0 | --- | MV DIN | 9,72<br>14,80<br>49,75 | 924,7<br>803,4<br>676,2 | 65,07 | 65,49 | 65,26 |
| 2 | 85 | 15 | --- | MV DIN | 9,68<br>14,67<br>49,83 | 957,0<br>848,0<br>685,0 | 65,09 | 65,45 | 65,48 |
| 3 | 100 | 0 | X | MV DIN | 9,72<br>14,72<br>49,83 | 903,9<br>807,8<br>720,4 | 65,07 | 65,25 | 64,98 |
| 4 | 85 | 15 | X | MV DIN | 9,84<br>14,76<br>49,75 | 943,2<br>857,9<br>737,9 | 65,13 | 65,32 | 65,37 |
| 5 | 100 | 0 | X | MV II P | 9,70<br>14,80<br>49,83 | 1228,3<br>1070,3<br>875,5 | 65,31 | 65,38 | 65,57 |

FIG.4

METHOD FOR THE PRODUCTION OF A COAL SUSPENSION

BACKGROUND OF THE INVENTION

The invention relates to improvements in method and apparatus for the production of a free flowing coal suspension high in solids content involving the comminuting of raw or processed coal or coal without prior thermal drying by the suspension of the particles in water and the addition of viscosity reducing additives.

In the handling of coal, aqueous coal suspension high in solids content can, like oil, be transported in pipelines in tankers, can be stored in tanks, and can be directly burned in power plants or other industrial firings or serve as charging stock for coal gasification.

Such coal suspensions offer various advantages with respect to environmental protection. In the matter of a railroad accident involving tank cars, for example, the environmental risk is reduced when the vehicle is loaded with a coal suspension instead of heating oil. When a coal suspension is produced from a low sulfur and low ash coal or from a correspondingly processed coal, then the environmental pollution is also correspondingly low. Coal suspensions enable pipeline transport over substantial distances without dewatering of the coal being necessary at the location where the coal is used. Coal transport by this means is praticularly advantageous in regions lacking the capability of other forms of transport.

In instances where transport is made of coal suspensions, the demands to be made of such suspension depend on the properties of coal to be utilized, and the type of transport provided, and on the intended employment of the suspension. In general, the properties of the coal can be designated by the following particulars:

- the solids content, usually 60, frequently 65% by mass percentage;
- the maximum grain size, usually 0.2 or 0.3 mm;
- the overs of a screen, limited in the coarse range, for example, a maximum of 10% coarser than 0.09 mm or a maximum of 30% coarser than 0.07 mm;
- the fine-grained component, usually slightly under 0.001 mm;
- an adequately low and chronologically constant viscosity given a corresponding shear rate (essential when used for pipeline transport over longer distances);
- an adequate stability during the intended transport and storing duration (i.e., no de-mixing based on grain size and solids concentration, particularly no formation of solid sediment).

The ignition and burn-out behavior of the coal particles and the demand to avoid unnecessary grinding costs result in that a grain size distribution, represented in the RRSB diagram (DIN 66145) should have approximately the shape of a backward "S" lying obliquely.

A so-called bimodel distribution with a mixing gap between 0.02 and 0.045 mm is recommended by Ferrini (Ferrini, F., et al) "Optimization of Particle Grading for High Concentration Coal Slurry", Preprint 132, 9th International Conference on Hydraulic Transport of Solids in Pipes, Rome, October 1984.

In accord with patent application, German No. 32 48 550 A1, a suitable size distribution of a coal suspension having excellent flowability is characterized in that the coal powder is 71 to 85% of mass coal particles having particle sizes of 74 μm or smaller. Further, over and above this, the requirement involves a particle size distribution that, given graphic representation of this particle size distribution in a "Rosin-Rammler Diagram", the slope of the straight line which connects two points—of which one corresponds to the quantity (in mass percent) of particles having particles below 44 μm and the other corresponds to the quantity (in mass percent) of particles having particle sizes below 74 μm—exhibits a value of 0.4 through 0.9 expressed as a value of tg $\alpha$.

Mutli-stage comminution and grading operations are unavoidable when transferring the above described scientific perceptions into large scale industrial practice. In order to be able to establish one of the aforementioned grain size distributions, the following operations are, for example, required in prior art practice. That is, a first grinding in a closed circulation, i.e., with a grading device upon return of the coarse product to a grain size below 0.3 mm, a second grading device then removes the component between 0.3 and 0.045 mm from the fine product as a first finished product component, and this is followed by a second grinding circulation with a further grading means in order to regrind the component finer than 0.045 mm to finer than 0.02 mm.

With respect to apparatus employed, ball mills and an air sifter operating dry after previous drying are suitable, whereby the drying and the first grinding stage can be combined as grinding and drying in an appropriately equipped system. However, it is not feasible energy-wise to first dry the coal in order to then in turn mix it with water to form a suspension.

Wet grinding with wet ball mills and with hydrocyclones (with super-fine wet screening as well as given coarse separating cuts) is also possible. In the grading, however, the solids content of the fine product is limited to under 40% mass so that further costs arise when the product must be concentrated to a solids content of 60 to 80% mass by means of thickeners, filters, centrifuges and the like. It is also known (R. Klimpel, Slurry Rheology Influence on the Performance of Mineral/-Coal Grinding Circuits, Mining Engineering Reprints, Dec. 1982 and Jan. 1983) to grind mineral raw materials given high solids contents with the addition of viscosity reducing reagents. The report describes the effect of reagents but provides no inducements as to how coal is to be mechanically treated in order to produce suspensions that are usable on a large industrial scale. The required grain size distribution, and particularly how it could be accomplished, are not discussed.

An object of the present invention is to obtain an economical method and apparatus for the production of a coal suspension for large scale industrial operations which does not exhibit the aforementioned disadvantages and deficiencies.

A feature of the invention in achieving the above object is accomplished in that at least a sub-quantity of the viscosity reducing additives are added to the coal before grinding given a solids content which is greater than or equal to the required solids content of the finished suspension and grinding is carried out in at least two stages with a mill having a calibrating effect being used in at least one grinding stage and a mill without calibrating effect is used in at least one grinding stage.

What is to be understood by a mill with a calibrating effect is a mill wherein either all grinding stock must pass an opening of a predefined size when it departs the grinding space such as, for example, a fine gyratory crusher, a sieve hammer pulverizer, sieve ball mills, or the structural type of operating mode of a mill which has the effect that the coarsest particles of the grinding stock are always primarily comminuted. This is especially the case with drum and vibration grinding mills in which rods serve as grinding bodies. Coarse particles are held by the rods at a distance so that the finer particles are not crushed by the rods.

A further object of the invention is to provide an improved method and apparatus for the production of a coal suspension which achieves the production of coal having the capabilities of fluid transport by more efficient and economical means than heretofore available.

An important feature of the invention is comprised in a combination of steps including at least two grinding stages having specific mills and no separate grading devices and no return is required. Also important is the addition of viscosity reducing agents before grinding. In accordance with the features of the invention, efficiency and economy is accomplished which is not anticipated.

Other objects, advantages and features will become more apparent with the disclosre of the principles of the invention in connection with the description of the preferred embodiment in the specification, claims and drawings, in which:

DESCRIPTION OF THE DRAWINGS

FIG. 4 is a tabular presentation illustrating the relationship between viscosity and concentration.

DESCRIPTION OF THE PREFERRED EMBODIMENTS

Figure 1:
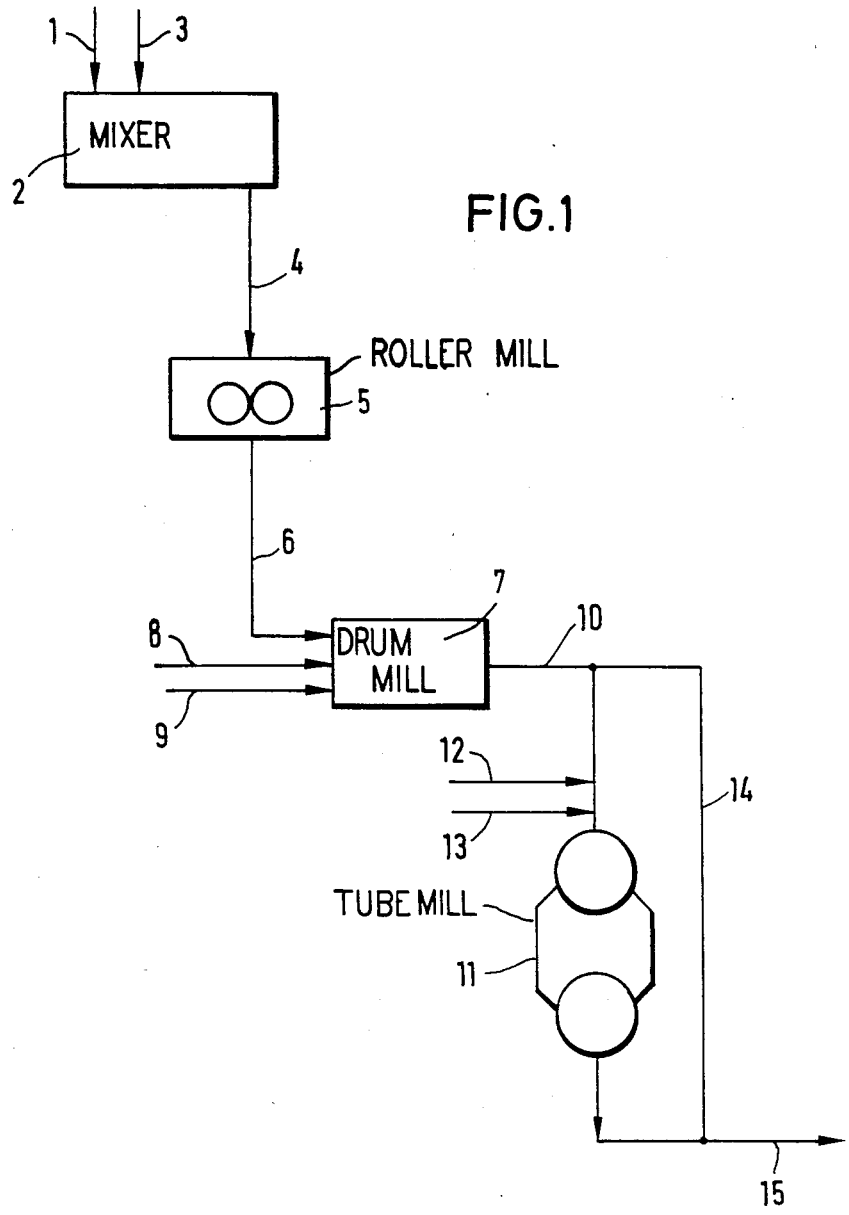
FIG. 1 is a diagrammatic illustration of a three-stage process.

The method and apparatus of the invention is set forth fundamentally with reference to a three-stage grinding process illustrated in FIG. 1. Processed fine coal is supplied at 1 and is compounded with a sub-quantity of a viscosity reducing reagent supplied at 3 to be mixed together in a mixer 2. The coal mixed with the reagent passes through a conduit 4 into a mill 5 without grading. A roller mill is well suited for this grinding of the type such as illustrated in German patent No. 33 02 176 A1 and is operated according to the principle of material bed comminution. The roller mill is charged with so much material that it presses the rollers apart to a nip width which is roughly equal to or greater than the maximum grain size of the charging stock. A calibration to a finer maximum grain size does not occur at this stage. On the contrary, the coal particles in the materials bed press against one another. One part is thereby already comminuted to the desired ultimate fineness, one part remains coarser, but a considerable portion receives cracks due to pressure and the comminution in the next stage is substantially promoted due to the cracks or weak spots.

The ground stock passes through a conduit 6 as it is discharged from the roller mill and is delivered to a mill 7 which has a calibration effect. In advance of the mill 7, the stock is compounded with a further sub-quantity of viscosity reducing additives added at 8 and with water added at 9. It is not absolutely necessary at this point for the desired water content of the finished suspension to exist and the water content can be lower and water and reagents will again be added at a later stage. The coal particles are then further comminuted in the drum mill 7 which has rods as grinding bodies and the suspension is also mixed within the drum mill 7 with the mill acting as a mixer. The rod mill 7 has a calibrating effect and the rods crush the coarsest particles in a suspension. With adequate dwell time in the mill, all particles in suspension can be comminuted, for example, to finer than 0.5 mm or finer than 0.3 mm with a rod mill and the demands made of the grain size distribution in the coarse phase can thus be met.

A higher superfine component in the suspension (acting as a "regulator" for viscosity, packing density and stability) is created in that at least one part of the discharge of the mill which flows as indicated at 10 is further "re-fined" by a tube vibration grinding mill with balls or other elements as grinding bodies. Here it is meaningful to again add water at 12 and viscosity reagents at 13.

The line 14 is connected such that only a substream of the suspension need be conducted through a tube vibration grinding mill 11. The suspension from the line 14 and from the discharge of the mill 11 is combined at 15, has a high solids content and is adequately free flowing.

The advantages of the method of the invention are included in the following:

- no grading devices are required;
- the coal does not have to be dried;
- no concentrating of the suspension is required after the grinding (a separate water circulation and a processing of contaminated excess water are thus eliminated);
- commercially available machines can be used, as will be set forth further herein;
- a suspension having a high solids content is obtained in an economical way.

Despite a solids content of 60% mass or more, the flowability is conditioned by the high superfine component which fills out the space between the "large" grains which are nevertheless limited in size. The roller mill for the material bed is advantageous to be used as a mill without calibrating inasmuch as it can process damp raw coal or damp washed coal without the risk of plugging and blockages. Also the use of the material bed roller mill effects an overall energy saving in being an efficient crushing vehicle. Wear occurs to only an insignificant amount at the roller mill because the particles essentially crush one another in the materials bed due to the pressure and are not directly stressed by impact, pressure or friction of the comminution tools and the high crushing pressures occur in the bed between the rollers. The additives or reagents which are included in the moisture between the coal particles are pressed into the pores and fissures of the particles. Thus, the new surfaces are, therefore, moistened with the reagents before further comminution so that a better overall effect is accomplished than when they are only stirred into suspension after grinding.

For the calibrating grinding stage, the drum mill with rods is particularly well suited. In addition to the calibrating effect, this mill has an advantage with coal water mixtures high in solids contents. When balls are used, they can start to adhere to the mill wall as a solid cake particularly with a solids content set slightly too high. If this occurs at some location and the grinding stock is no longer transported through the mill in the normal way, the cake formation begins to progress and the grinding process fails and the mill will block. This risk is eliminated when rods are employed as grinding bodies. The rods have roughly the same length as the mill and a high mass and they will always tear away from a locally formed cake of solids and again disperse the solids.

Maximum grain sizes down to 0.3 mm, and at the utmost 0.2 mm can be achieved with rod drum mills. An even finer grinding runs afoul of the manufacturing precision or the irregular wear of the rods when circumstances require that the maximum grain size be limited to values finer than 0.3 mm, than tube vibration grinding mills with rods as grinding bodies offer particular advantages. Maximum grain sizes of 0.2 mm can be achieved or even smaller grain sizes can be attained without particular difficulties with rodded tube vibration grinding mills. The risk of a baking or solidification of the mill contents is slight in a rodded tube vibration grinding mill for the reasons set forth above relative to rod drum mills. In tube vibration grinding mills, the accelerations of the grinding bodies are on the order of seven times the acceleration due to gravity. The grinding bodies in such mills are, therefore, particularly capable of carrying out the grinding work in the high solids content, and therefore relatively high viscosity slurry. Mills of this type are known and sold under the trademark Palla mills.

A tube vibration grinding mill is usually designed as a double tube vibration mill and is optionally operated in parallel connection or with a center feed. Such mills can be particularly well adapted with respect to dwell time and grinding path to changing operational demands, particularly in high viscosity slurries.

Due to the higher force of impact, tube vibration grinding mills, particularly double tube vibration grinding mills are particularly well suited for a last, "non-calibrating" grinding stage using balls or cylpebs (which are elements having short cylindrical shapes for use in ball mills).

In an alternative form of the method as described above, a part of the finely ground suspension is recirculated in one or more of the grinding stages. As a result of this modification, the viscosity of the grinding stock is reduced in these grinding stages and the required grinding duration is shortened thus leading to a reduction in energy expenditure.

It is proven particularly beneficial to provide the addition of viscosity reducing additives preceding the individual grinding stages. One reason for this is that new surfaces in the coal are created in each grinding stage. The action of the reagents is thus improved and with a given amount of reagent, lower viscosities for the final product are achieved. In other words with a given quantity of additive, an improved viscosity and improved transportation capabilities are attained. The specific surface accretion can be identified, for example, when the grain size distribution following each grinding station is identified in preliminary tests and a specific surface is identified by sections from the line shown in the RRSB diagram of FIG. 3.

Figure 2:
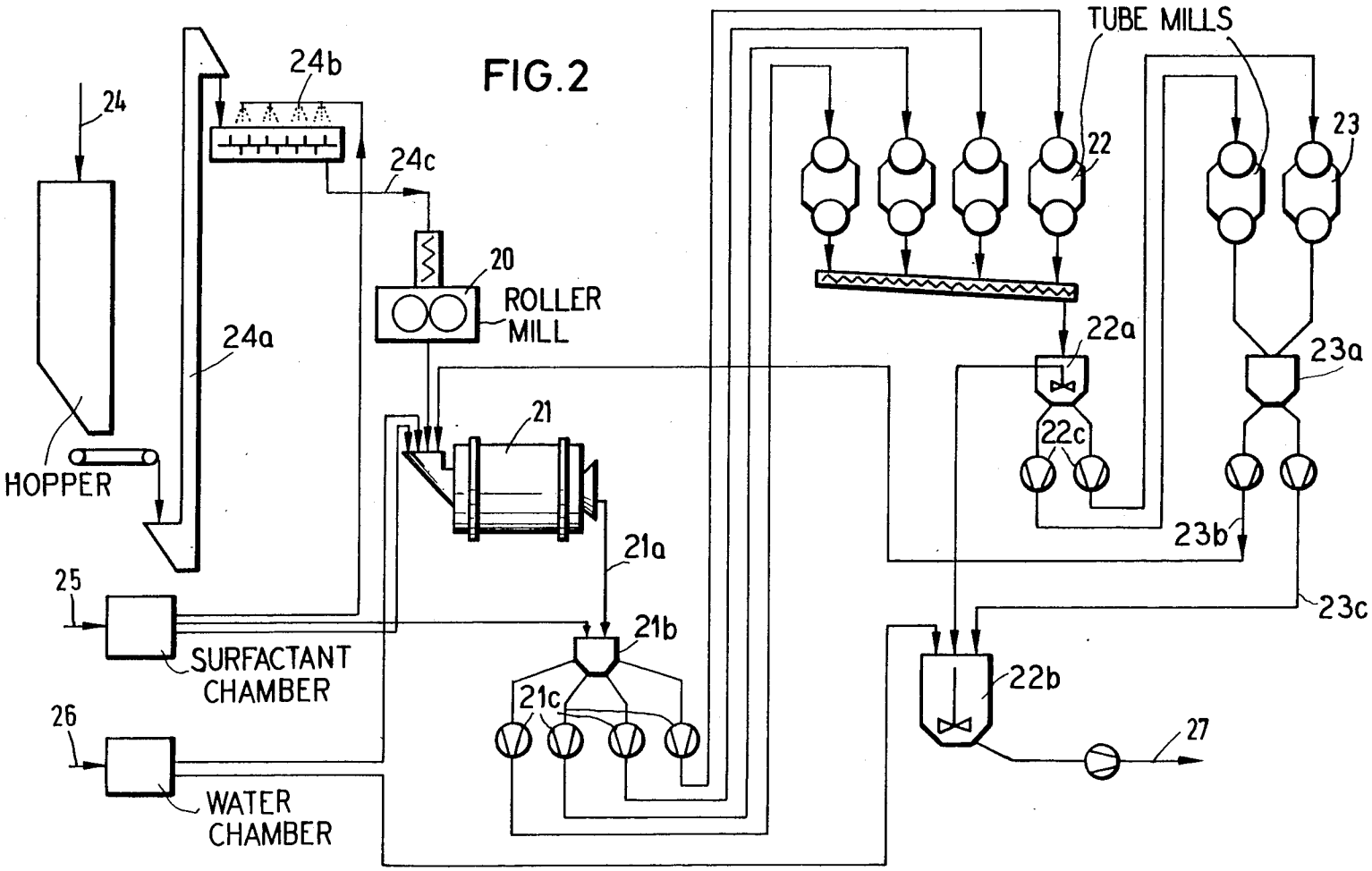
FIG. 2 is a somewhat schematic or diagrammatic illustration of one preferred embodiment utilizing a high pressure roller mill, a rod drum mill, a rod vibration grinding mill, and a vibration grinding mill with elements as grinding bodies.

FIG. 2 illustrates a pilot system in somewhat greater detail. With reference to the mechanisms employed, the following particulars are relevant:

A high pressure roller mill 20 is shown having a roller diameter of 800 mm and a roller width of 120 mm.

A drum mill 21 as a rod mill is employed having a diameter of 410 mm and a length of 600 mm. The speed at which the mill has been run is 75% of the critical speed.

Vibration grinding mill with rods 22 or ball or cylinders or cylpebs 23 as grinding bodies may be employed. The grinding vessel has a content or 9.4 L and is mounted on a vibratory frame of an operating mill which is a Palla type 20 U; the oscillatory circuit diameter is 12 mm and the frequency is 1000 $min^{-1}$ The prepared coal which enters the system at 24 has an ash content of 5% mass (with reference to a water-free substance) and a grain size finer than 12 mm and 18% mass water content.

Surfactants on a polyether basis and lecithin are employed as viscosity reducing additives added to the system at 25. Defrothing agents are also added in part. In all, about 1.71% polymer surfactant and 0.85% lecithin are added with reference to the dry matter.

Water is added at 26 with only a portion of this water being mixed with the coal in the rod drum mill 21. The remaining water is not added to the suspension until the vibration grinding mills later in the system. At no point in the process is the solids content lower than in the finished suspension which is delivered at 27. It has been found that a solid cake does not yet form given a solid content of up to 70% mass. The following should be noted. The geologically recent coal which has been processed in the system has an equilibrium moisture content of 8.6%, i.e., referred to as the coal constituent. 8.6% of the water is bonded in the interior of the coal grains and is not available as a carrier fluid. 70% of the mass, therefore, corresponds to about 75% mass given a standard Ruhr region type coal, i.e., coal obtained in the Ruhr area of Germany.

Work in every grinding stage can be carried out with a solids content of up to 70% mass when an adequate quantity of additive is added. The upstream connection of a high pressure roller mill reduces the grinding duration in a rod drum mill by at least 25%. Although the majority part of the grinding stock is already finer than 0.2 mm (which amounts to about 20% of overs) with a rod drum mill after a short grinding duration (5 minutes), the grinding process then slows down (about 5 to 9% overs after 20 minutes, with about 1% overs after 27 minutes depending on the setting of the remaining parameters). It also turns out that stock ground for about 20 minutes in the bar mill can be reground to 3.8% overs, given 0.2 mm, in a rod vibration grinding mill in a very brief grinding duration of 1.7 minutes. The last percentages coarser than 0.2 mm are accordingly more economically annihilated with rod vibration grinding mills than with the rod drum mill.

Given the suitable combination in the arrangement described, the grinding duration in the rod drum mill in these examples amounted to 14.5 minutes, 1.7 minutes in the rod vibration grinding mill, and 2.4 minutes in the vibration grinding mill with cylinders.

It has proven beneficial to recirculate a very small sub-stream of finely ground slurry. This slurry is visibly more fluid after every grinding stage than in preceding individual charges tests.

The additives were added in sub-quantities preceding every grinding stage. Referring to the overall quantity, 15% was added preceding the high pressure roller mill, 75% preceding the rod drum mill and 10% preceding the rod vibration grinding mill.

While the schematic diagram will be clear from FIG. 2, the coal enters at 24, is passed downwardly to a conveying device such as a chain bucket elevator 24a, subjected to the addition of viscosity reducing additives 25 at a spray 24b and delivered through a conduit 24c to the roll mill. From the roll mill, the coal passes to the drum mill 21. From the drum mill, the discharge passes through a line 21a for further addition of additives at 21b and the discharge from 21b is passed through distributor valves 21c to flow through suitable conduits to the vibration grinding mills 22. The discharge from the mills 22 passes to a separator 22a with a fine portion passing down to a collector 22b and other portions passing through valves 22c to be delivered to the grinding mills 23. The discharge from the mills 23 passes to a separator 23a with the coarse portion delivered through line 23b back to the drum mill 21 and the finished portion being delivered through the line 23c down to the collector 22b with the finished material being delivered through the line 27.

It has proven beneficial to recirculate a small substream of slurry even though finely ground. The slurry is visibly more fluid after every grinding stage than in preceding individual deliveries.

The additives were added in sub-quantities preceding each grinding stage. Referring to the overall quantity, 15% was added preceding the high pressure roller mill, 75% preceding the rod drum mill, and 10% preceding the rod vibration grinding mill.

Figure 3:
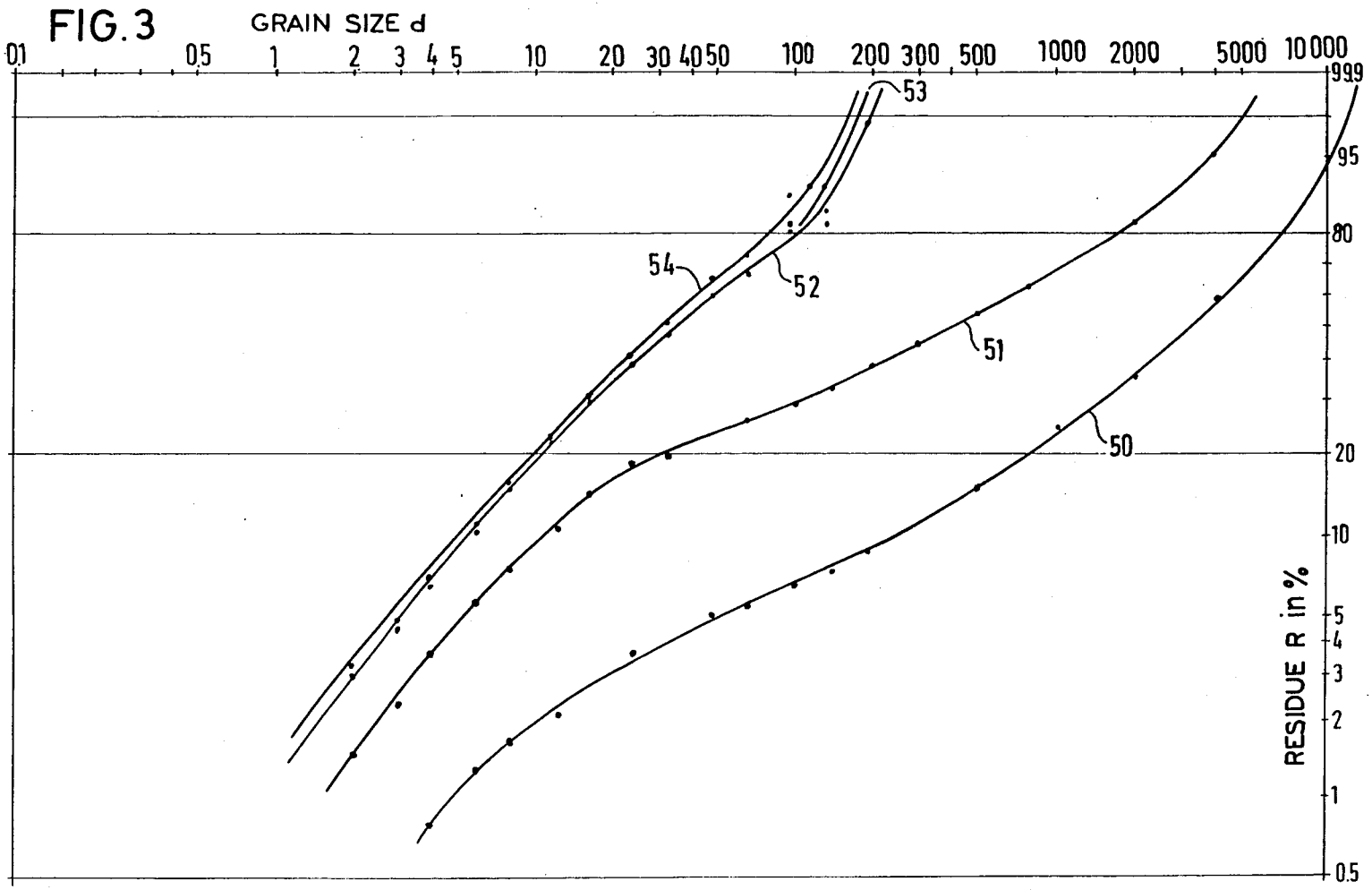
FIG. 3 is a graph presenting a comminution result in a RRSB diagram.

The comminution result, i.e., the grain size distribution of the ground products produced is illustrated in FIG. 3 in the RRSB diagram. Shown thereon are the grain size distributions of the charge (curve 50) and of the discharge (curve 51) of the high pressure roller mill. Curve 52 is the grain size distribution of the rod drum mill discharge and curve 53 that of the rod vibration grinding mill discharge. The slurry re-fined in the vibration mill with cylinders exhibits the grain size distribution entered as curve 54 (all grain size distributions identified manually above 0.2 mm by wet test screening, including identification by means of "Cilas" grain size measuring instrument). Curve 53 is only entered in the coarse region since it does not differ substantially from curves 52 and 54.

The grinding work is essentially performed by the high pressure roller mill in the rod drum mill. The degrees of comminution, expressed as the ratio of the values "d" in the RRSB diagram, amount to

| | from d mm | to d mm | Degree of Comminution |
|---|---|---|---|
| HPRM | 4.6 | 0.78 | 5.9:1 |
| Rod Drum Mill | 0.78 | 0.045 | 17.3:1 |

The only job of the rod vibration grinding mills is to calibrate the last coarse fractions (over 0.2 mm). In accord therewith and due to the short grinding duration, the middle and superfine region are only slightly influenced.

The rheological behavior is shown in a table in FIG. 4 based on a selection of the results of viscosimeter measurements. What are shown are the results of respectively two measurements with 100% rod vibrating grinding mill discharged on the one hand, and a mixture of 85% rod vibrating grinding mill discharge and 15% suspension re-fined in the cylindrical element mill, respectively, with and without addition 0.2% (referred to the solids content) defrother (Baymin 4001), all with a smooth-walled measuring head and further testing with a profiled measuring apparatus.

The specimens are set to 65% solids contents in all cases.

The profiled measuring apparatus supplies somewhat greater viscosities. This infers a certain wall glide effect in the measurement with a smooth-walled measuring head.

The admixture of 15% re-fined suspension appears to obtain slightly higher viscosities, however, it improves the stability.

The addition of the defrother effects a lower viscosity given a lower shear rate but usually effects a somewhat higher viscosity given a higher shear rate.

Figure 5:
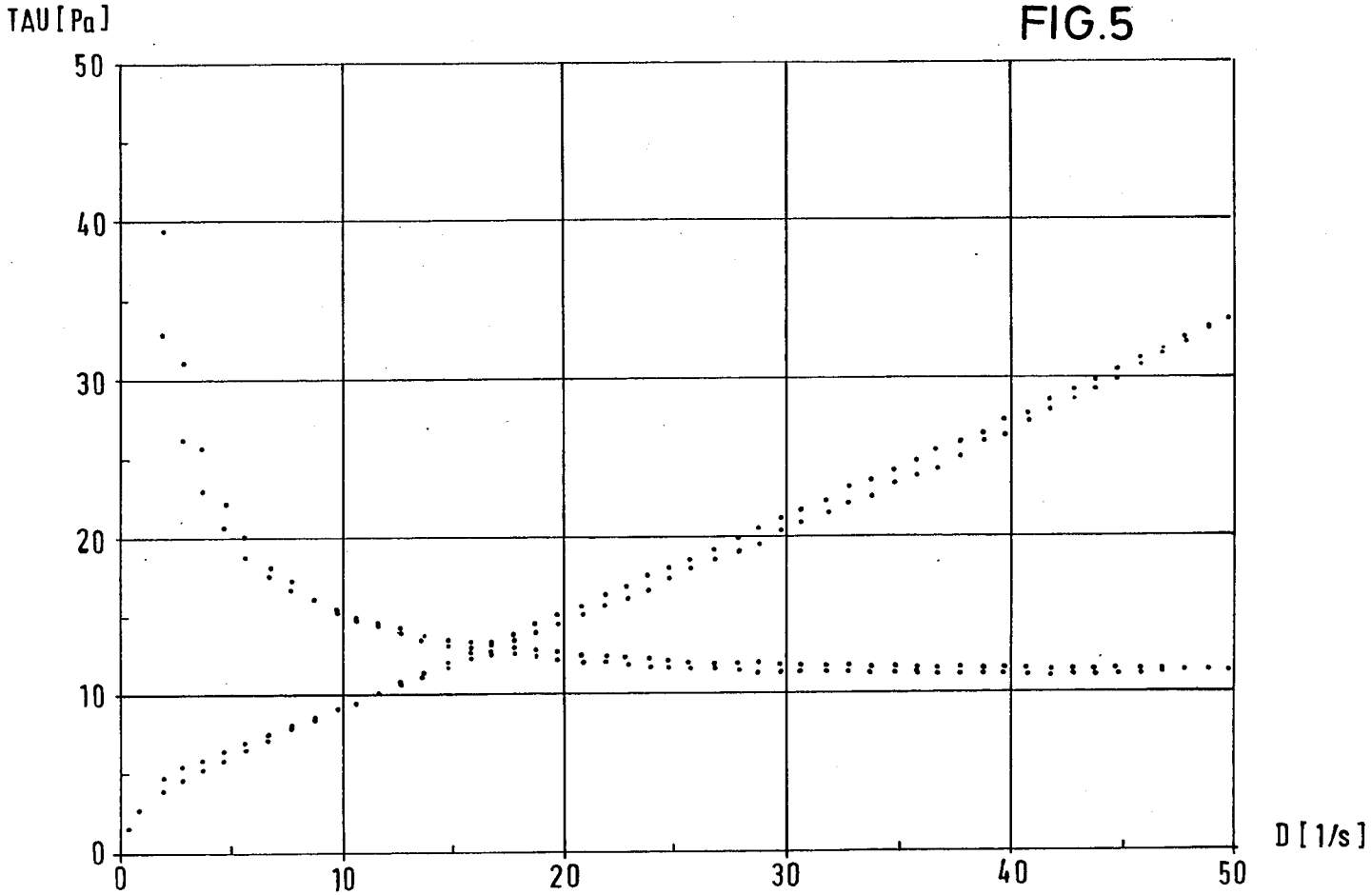
FIG. 5 is a graph representing the relationship of tau/D.

FIG. 5 shows the "Tau/D Curve" pertaining to Test 1 of FIG. 4. The pumpability of the specimens in accord with the invention does not decrease over time.

Thus, it will be seen we have provided a method and apparatus which obtains the objectives set forth and which attains the results of efficiency and improved transportability of ground coal.

We claim as our invention:

1. The method of the production of a free flowing coal suspension in water and viscosity reducing additives high in solids content by comminution of coal without prior thermal drying comprising the steps:

adding viscosity reducing additives to the coal;

passing the coal with the additives through a high pressure roller mill with the additives pressed by the roller mill into the pores and fissures of the particles formed in the roller mill so that the formed surfaces are moistened without risk of plugging and blockage of the mill;

adding viscosity reducing additives to the coal after the high pressure roller mill;

and thereafter passing the coal through a calibrating mill forming a high viscosity slurry improving the action of the additives for improved viscosity and transportation capabilities of the coal.

2. A method for the production of a free flowing coal suspension in water and viscosity reducing additives high in solids content by comminution of coal without prior thermal drying in accordance with the steps of claim 1:

wherein a rotating drum mill with rods as grinding bodies is utilized in said calibrating step.

3. A method for the production of a free flowing coal suspension in water and viscosity reducing additives high in solids content by comminution of coal without prior thermal drying in accordance with the steps of claim 1:

wherein a tube vibration grinding mill with rods as grinding bodies is utilized in said calibrating step.

4. A method for the production of a free flowing coal suspension in water and viscosity reducing additives high in solids content by comminution of coal without prior thermal drying in accordance with the steps of claim 1:

wherein a tube vibration grinding mill with cylindrical grinding bodies is utilized in the calibrating step.

5. A method for the production of a free flowing coal suspension in water and viscosity reducing additives high in solids content by comminution of coal without prior thermal drying in accordance with the steps of claim 1:

wherein a portion of the output of at least one of said grinding steps is recirculated into a grinding step to be reground.

6. A method for the production of a free flowing coal suspension in water and viscosity reducing additives high in solids content by comminution of coal without prior thermal drying in accordance with the steps of claim 1:

wherein the addition of viscosity reducing additives added before each step is in the same ratio relative to the surface area newly formed in each grinding step.

7. A method for the production of a free flowing coal suspension in water and viscosity reducing additives high in solids content by comminution of coal without prior thermal drying in accordance with the steps of claim 1:

wherein the dry matter content following each grinding step amounts to at least 60% mass.

8. An apparatus for the production of a free flowing coal suspension in water and a viscosity reducing additive reducing additive being high in solids content by comminution of coal without prior thermal drying comprising in combination:

means for adding viscosity reducing additives to the coal;

a high pressure roller mill positioned to receive the coal from said viscosity apparatus adding means with the additives pressed by the roller mill into the pores and fissures of the particles formed by the roller mill and so that newly formed surfaces are moistened without risk of plugging and blockage of the mill;

means after the roller mill adding additives to the coal; and a calibrating mill providing a second grinder positioned to thereafter receive the coal, the mill improving the action of the additives for improved viscosity and transportation capabilities of the coal.

9. A mechanism for the production of a free flowing coal suspension in water and a viscosity reducing additive being high in solids content by comminution of coal without prior thermal drying constructed in accordance with claim 8:

wherein the second of said grinders is a grinding mill with rods as grinding bodies therein.

10. A mechanism for the production of a free flowing coal suspension in water and a viscosity reducing additive being high in solids content by comminution of coal without prior thermal drying constructed in accordance with claim 8:

wherein the second of said grinders is a rotating drum mill with rods as grinding bodies and the third of said grinders is a vibration mill with cylindrical bodies therein.

11. A mechanism for the production of a free flowing coal suspension in water and a viscosity reducing additive being high in solids content by comminution of coal without prior thermal drying constructed in accordance with claim 8:

including means for separating a sub-stream from the output of at least one of said grinders and conducting said sub-stream back to the input of one of said grinders.

12. A mechanism for the production of a free flowing coal suspension in water and a viscosity reducing additive being high in solids content by comminution of coal without prior thermal drying constructed in accordance with claim 8:

wherein the second and third of said grinders are vibration grinding mills with rods, and a fourth grinder is a tube vibration mill with spherical bodies therein.

13. An apparatus for the production of a free flowing coal suspension in water and a viscosity reducing additive being high in solids content by comminution of coal without prior thermal drying comprising in combination:

a high pressure roller mill operated on the principle of product bed comminution for grinding coal forming new surfaces in the coal particles;

means for delivering a quantity of viscosity reducing additive before the roller mill so that the additive is pressed into the pores and fissures of the particles formed by the roller mill to moisten the newly formed surfaces;

means for delivering a portion of viscosity reducing additive to material passing from the roller mill to a rotating drum mill;

a tube vibration grinding mill with rods connected to receive the output from said rotating drum mill;

means for delivering a portion of a viscosity reducing additive to material passing from said drum mill to said vibration mill;

a last tube vibration mill with cylindrical bodies therein connected to receive material from said vibration mill;

and recirculation means for receiving a portion of material emanating from said last mill and delivering said portion back to an input to said tube vibration grinding mill.

14. A method for the production of a free flowing coal suspension in water and viscosity reducing additives high in solids content by comminution of coal without prior thermal drying comprising the steps of:

mixing a portion of viscosity reducing additives to the coal particles;

and grinding said coal particles with said portion of viscosity reducing additives in a sequence of separate grinding steps including at least two stages, the first of said two stages being accomplished with a high pressure roller mill operated on the principle of product bed comminution and the second of said two stages being accomplished with a mill having a calibrating effect.

* * * * *